US005547340A

United States Patent [19]

Dalton et al.

[11] Patent Number: 5,547,340

[45] Date of Patent: Aug. 20, 1996

[54] SPILLSTRIP DESIGN FOR ELASTIC FLUID TURBINES

[75] Inventors: William S. Dalton, Chesterfield; Richard S. Clark, Feeding Hills; Kevin S. Trunkett, Springfield, all of Mass.

[73] Assignee: IMO Industries, Inc., Lawrenceville, N.J.

[21] Appl. No.: 216,685

[22] Filed: Mar. 23, 1994

[51] Int. Cl.[6] ..... F01D 11/08

[52] U.S. Cl. ..... 415.00/121.2; 415/173.5; 415/173.6; 415/174.5; 277/53

[58] Field of Search ..... 415/121.2, 169.1, 415/173.1, 173.5, 173.6, 173.7, 174.5; 277/53

[56] References Cited

U.S. PATENT DOCUMENTS

| | | | |
|---|---|---|---|
| 3,594,010 | 7/1971 | Warth | 277/53 |
| 3,597,102 | 6/1971 | Unsworth et al. . | |
| 3,944,380 | 3/1976 | Kampe . | |
| 4,402,515 | 9/1983 | Malott . | |
| 4,436,311 | 3/1984 | Brandon | 277/27 |
| 4,545,725 | 10/1985 | Ikeda et al. | 415/169.1 |
| 4,662,820 | 5/1987 | Sasada et al. | 415/173.6 |
| 4,721,313 | 1/1988 | Pennink . | |
| 5,049,032 | 9/1991 | Brandon . | |
| 5,271,712 | 1/1993 | Brandon . | |

FOREIGN PATENT DOCUMENTS

| | | | |
|---|---|---|---|
| 382333 | 8/1990 | European Pat. Off. | 415/174.5 |
| 52-35303 | 10/1978 | Japan . | |
| 14402 | 1/1986 | Japan | 415/173.6 |
| 920236 | 4/1982 | U.S.S.R. . | |

OTHER PUBLICATIONS

Turbin Product Brochure from the Quabbin Division of IMO Industries, Inc., Turbine Geometry, Sep., 1992.

*Primary Examiner*—Edward K. Look
*Assistant Examiner*—James A. Larson
*Attorney, Agent, or Firm*—Hopgood, Calimafde, Kalil & Judlowe

[57] ABSTRACT

Disclosed is an improved spillstrip ring for use in forming a tip seal in an axial flow elastic fluid turbine having one or more stages. Each turbine stage has a diaphragm and a rotor. The spillstrip ring consists of an arrangement of spillstrips mounted in a circumferentially groove formed in the diaphragm. Each spillstrip includes a body portion having a longitudinal extent, a vertical extent, and a horizontal extent, and is particularly adapted for mounting in the circumferential groove in the diaphragm. At least one projection extends from the body portion substantially parallel to the vertical extent thereof, and along the longitudinal extent of the body portion. Such projection has tapered side walls which converge to a tip seal that continuously extends along the longitudinal extent of the body portion. At least one of the spillstrips has at least one narrow channel formed entirely through a portion of the vertical extent of the body portion and beneath each projection, without interrupting the tip portion continuously extending along the longitudinal extent of the body portion. During turbine operation, the channel functions to bypass oxide particles entrained in the steam flow, around the rotor blades in order to reduce the residing time of these particles between the rotor blades and diaphram nozzles, without interrupting the continuously extending tip seal.

12 Claims, 9 Drawing Sheets

SPILLSTRIP DESIGN FOR ELASTIC FLUID TURBINES

BACKGROUND OF THE INVENTION

1. Field of Invention

The present invention relates generally to an improved tip (i.e., spill) seal design for use in axial flow elastic fluid turbines, and more particularly to an improved spillstrip for use therein to permit improved removal of hard metallic particles from the steam flow through such turbines, for the purpose of minimizing blade wear, turbine maintenance and repair, and thus cost of machine operation.

2. Brief Description Of The Prior Art

The use of axially flow elastic fluid turbines, such as axially flow steam turbines, plays a very important role in the production of electric power in our society. In order to produce electrical power from an electrical power generator installed at a power plant, it is necessary to rotate the rotor shaft thereof in a magnetic field produced by the stator field windings of the power generator. Typically, the torque required to rotate the rotor shaft at a sufficient angular velocity is provided by a steam turbine whose output shaft is mechanically coupled to the rotor shaft of the generator. Often, in a typical power plant, there will be a number of steam turbines each driving one or more electrical power generators.

In general, each steam turbine comprises a shaft rotatably supported by bearings which are encased in a housing or casing. In order to rotate the turbine shaft using the momentum of super-heated vapor (i.e., "steam"), a series of turbine stages are sequentially arranged along the axis of the shaft. A boiler, typically located external to the turbine casing, is provided for the purpose of generating steam. External to the turbine casing are steam pipes which are used to conduct the steam from the boiler to particular sections of the turbine, that are typically classified by operating pressure. Along each section of the turbine, there are typically a number of turbine stages.

At each turbine stage, a turbine rotor is fixedly mounted to the turbine shaft. Each turbine rotor has a plurality of blades which radially extend a predetermined distance from the shaft, towards a circumferentially extending shroud band (i.e., cover) that is secured to the tenon portions of the blades. In general, each turbine blade is oriented at an acute angle with respect to the axis of rotation of its rotor. In order that each turbine rotor is permitted to freely rotate with the turbine shaft, the turbine casing has circumferential recesses to accommodate the rotor structures along the shaft. A stationary diaphragm is installed behind each rotor in a circumferential joint formed in the turbine casing. Each turbine has a ring of steam nozzles circumferentially extending about the inner structure of the diaphragm. These nozzles are located at the same radial position as the blades in its associated rotor. The function of each nozzle is to receive steam from the passageways in the turbine casing and to physically direct the steam against the rotating blades of its associated rotor. To establish a "tip seal" with the shroud band of each turbine rotor, a ring of spillstrips is supported from the diaphragm at each stage.

As the steam travels along a helical path through the turbine, a portion of its linear momentum is transformed into the angular momentum of the rotor blades at each turbine stage, thereby imparting torque to the turbine shaft. At each subsequent stage, the pressure of the steam path is typically reduced. Thus at these downstream stages it is often necessary to increase the length of the rotor blades and the size of the associated diaphragms in order to extract kinetic energy from axially flowing steam of reduced pressure.

In recent times, steam turbine design has been concerned primarily with two problem areas, namely: (i) the quality of steam seals between the various stationary and rotating components along the steam flow path in the turbine; and (ii) the wear of components caused by the presence of hard particulate matter (e.g., oxide and other metallic particles) in the steam path through the turbine.

In general, the first problem has been addressed by improved designs in packing rings, retractable packing seals, and seal rings.

Recently, the second problem has been addressed in U.S. Pat. No. 5,271,712 to Brandon, which is incorporated herein by reference in its entirety. In this prior U.S. Patent, Brandon discloses an improved spillstrip having a "through opening" formed in its tip seal portion. While the spillstrip design of U.S. Pat. No. 5,271,712 permits particles entrained in the steam path to pass through the "through opening" in its tip seal portion, this prior art design suffers from a number of significant shortcomings and drawbacks.

In particular, the introduction of one or more through-openings in the tip seal portion of the spillstrip ring about each turbine rotor causes a break in the tip seal. These breaks in the tip seal allow steam to flow therethrough which otherwise should pass over the blades of the rotor and impart torque to the turbine shaft. In addition, as particles entrained in the steam flow are directed outwardly against the outer diaphragm walls due to centrifugal forces acting thereupon, these particles are less likely to move radially inwardly where the through-openings in the tip seal are formed. These particles tend not to pass quickly through the through-opening(s) and downstream along the turbine where the particles can be effectively removed. Thus, with the spillstrip design proposed in U.S. Pat. No. 5,271,712, the resident time of particles at any particular stage of the turbine will be substantially higher than desired. Consequently, these particles are permitted to erosively damage the rotor blades during their extended residency between the rotor blades and diaphragm nozzles at each turbine stage.

Thus, there is great need in the art for a spillstrip design that can be used to create an improved tip seal in an axial flow elastic fluid turbine, while effectively reducing turbine part wear along the various stages thereof.

OBJECTS AND SUMMARY OF THE INVENTION

Accordingly, it is a primary object of the present invention to provide an improved spillstrip design for use in creating an improved tip seals in axially flow elastic turbines, while effectively reducing turbine part wear along the various stages thereof.

A further object of the present invention is to provide such a spillstrip design, which effectively reduces turbine part wear by permitting particles entrained in the steam path flow to quickly travel through the various stages of the turbine.

A further object of the present invention is to provide an improved tip seal which effectively reduces turbine part wear, while minimizing the reduction of steam pressure across the spillstrip ring at each turbine stage.

A further object of the present invention is to provide an improved tip seal in an elastic turbine that exploits the fact that particles entrained in the steam flow path of the turbine are more likely to reside along the outermost portions of the turbine diaphragms due to centrifugal forces acting thereupon.

A further object of the present invention is to provide a computer-assisted method of strategically installing spillstrips of the present invention along each stage of a turbine shut down for repair and/or maintenance.

A further object of the present invention is to provide such a method of spillstrip installation in a turbine, in which acquired knowledge of surface wear therein is used to install one or more spillstrip elements of the present invention at strategic locations about each turbine stage so that particles entrained in the steam flow path are permitted to bypass the rotor blades thereof in a manner which minimizes the resident time of the entrained particles in the turbine, thereby effectively reducing turbine part wear.

An even further object of the present invention is to provide an axial flow steam turbine which incorporates novel spillstrip rings constructed in accordance with the principles of the present invention.

These and other objects of the present invention will become apparent hereinafter.

BRIEF DESCRIPTION OF THE DRAWINGS

For a more complete understanding of the Objects of the Present Invention, the following Detailed Description of the Illustrative Embodiment should be read in conjunction with the accompanying drawings, in which.

DETAILED DESCRIPTION OF THE ILLUSTRATIVE EMBODIMENTS OF THE PRESENT INVENTION

Figure 1:
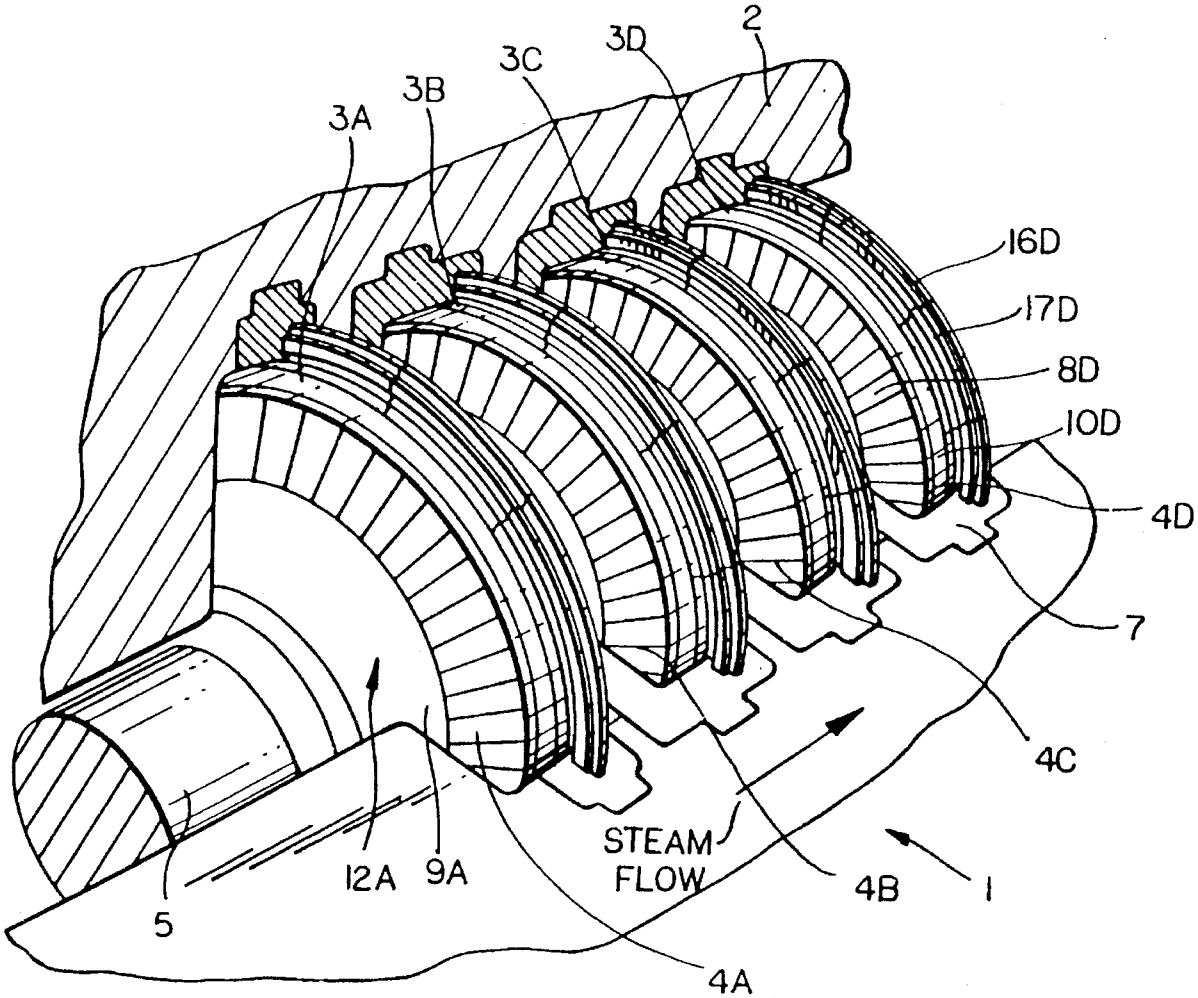
FIG. 1 is a perspective, partially fragmented view of a multi-stage axial flow steam turbine of the present invention, showing the diaphragm and rotor components of each stage housed within the turbine outer casing.

In general, the axial flow steam turbine 1 of the present invention generally comprises a number of turbine sections which are conventionally classified by operating pressure. Along each turbine section, a number of stages are encased within outer turbine casing 2 as shown in FIG. 1. In the illustrative embodiment, these turbine stages are identified by 3A, 3B, 3C, and 3D. In general, however, the number of stages will vary from embodiment to embodiment of the present invention. Hereinafter, like reference numerals are used to indicate like structures in the drawings.

As shown in FIG. 1, each stage of the turbine has a similar arrangement of subcomponents. However, for purposes of clarity, reference shall be made in the illustrative embodiments to the first stage of the turbine, and each of its respective subcomponents shall be indicated in the figures by character "A" following its primary reference numeral. Similarly, each subcomponent associated with the second, third and fourth stages of the turbine of FIG. 1 shall be indicated by reference characters B, C, and D, respectively, following its primary reference number.

Figure 2:
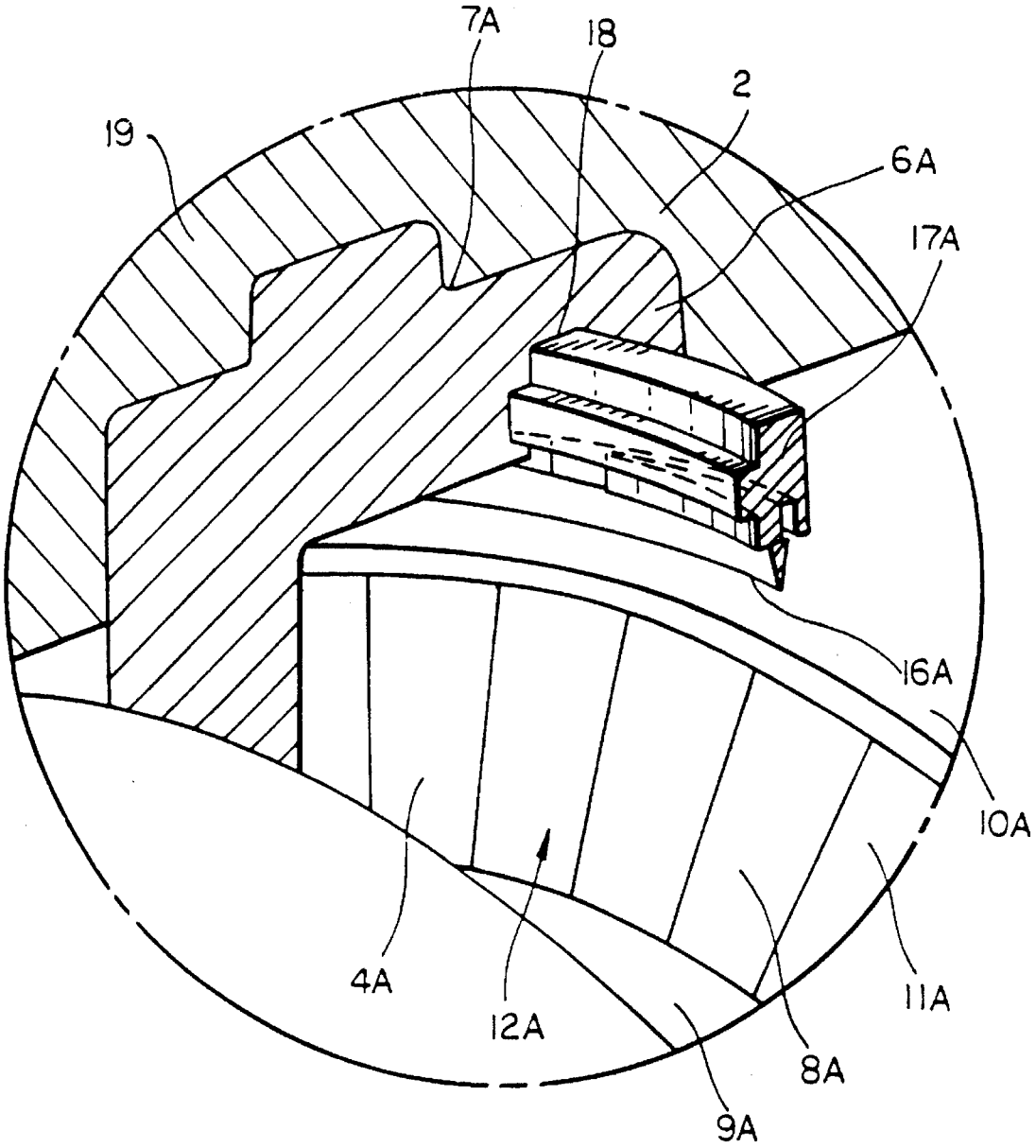
FIG. 2 is a perspective, partially fragmented view of a turbine stage of the present invention, showing a portion of the spillstrip of the present invention, and the manner in which it is supported by the turbine diaphragm and forms a continuous tip seal with the shroud band of its associated rotor.

As shown in FIG. 2, in particular, the first stage of the turbine comprises a turbine rotor 4A fixedly mounted to the turbine shaft 5, and an associated turbine diaphragm 6A stationarily mounted in a joint 7A in the outer turbine casing 2A. The position of each turbine rotor is located slightly downstream from its associated diaphragm. As shown in the drawings of FIGS. 1, 3, 4, 7, 8, 9, and 10, the downsteam flow direction is indicated by a right-hand directed arrow. As shown, turbine rotor 4A has a ring of turbine blades 8A which extend radially outward from inner ring 9A, towards a circumferentally extending shroud band (i.e., rotor cover) 10A, that is secured to the tenon portion 11A of each blade in the rotor.

Figure 3:
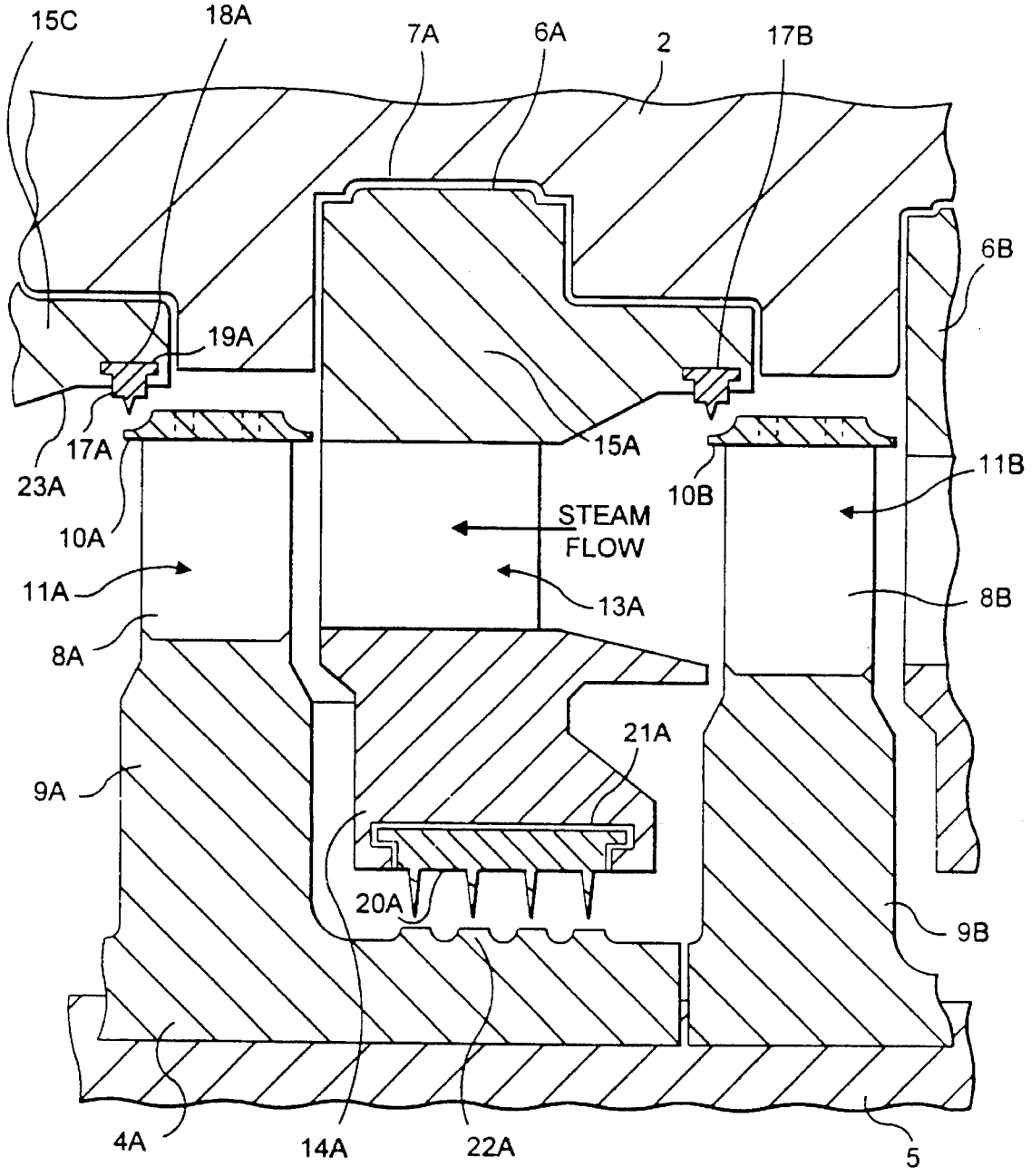
FIG. 3 is a cross-sectional view of a turbine stage of the present invention, showing the first illustrative embodiment of the spillstrip ring and the manner in which it extends from a diaphragm stationarily installed in the outer turbine casing, and establishes a continuous tip seal with the shroud band of its associated rotor.

As shown in FIGS. 2 and 3, turbine casing 2 has circumferential chamber 12A for accommodating the geometry of rotor structure 4A along the shaft, and the geometry of each turbine diaphragm. Turbine diaphragm 6A has a ring of steam nozzles 13A circumferentially extending about the inner and outer ring portions 14A and 15A of the diaphragm.

The radial position of the steam nozzles in any particular diaphragm is at substantially the same as the radial position of the ring of turbine blades in its associated rotor. The function of steam nozzle 13A in stationary diaphragm 6A is to receive steam from the passageways in the outer turbine casing and to physically direct this steam against the rotating blades of its associated rotor 4A. Preferably, the steam is directed against the rotating turbine blades at an angle selected to maximize momentum transfer to the turbine shaft and rotor assembly.

Figure 6:
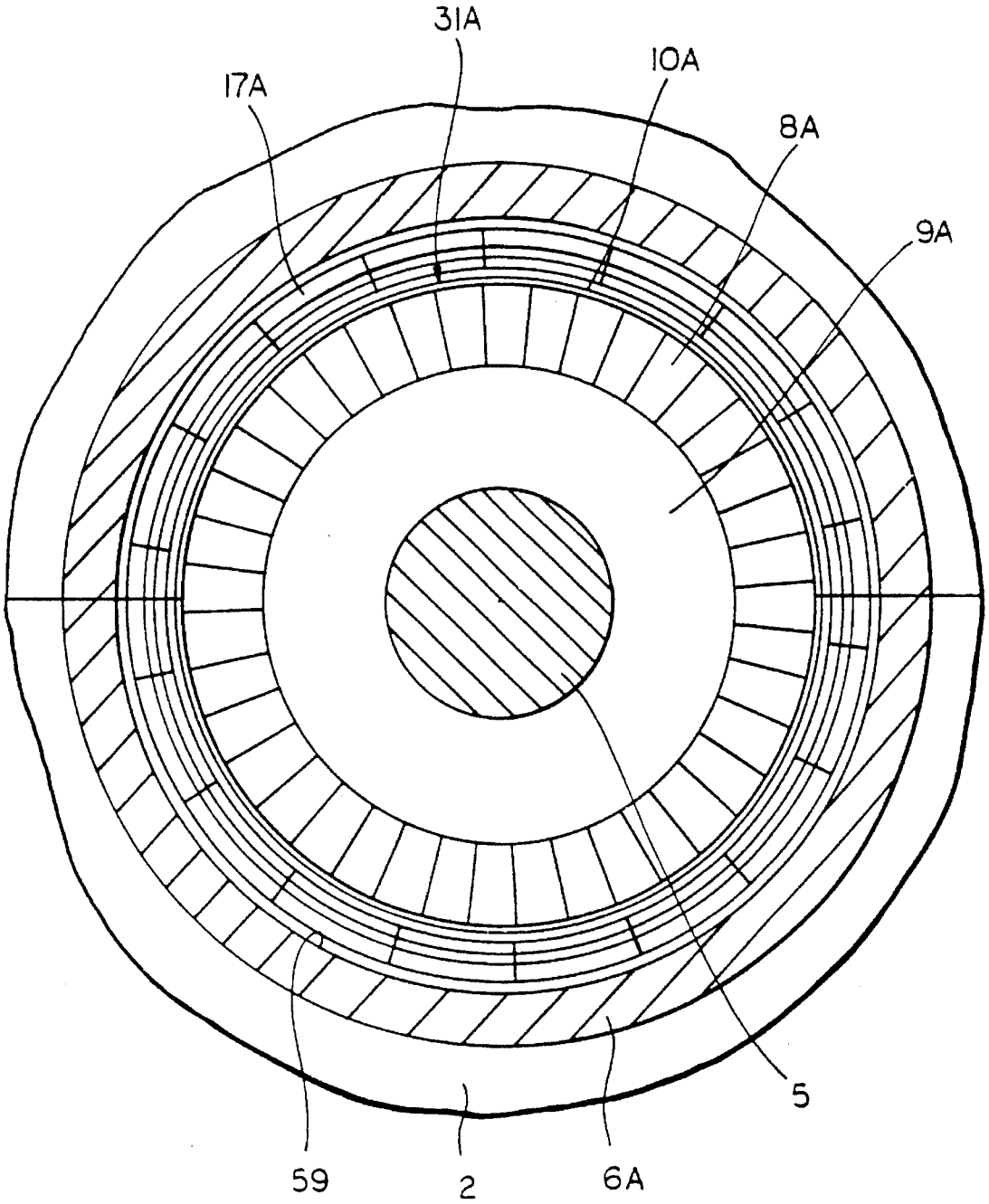
FIG. 6 is a cross-sectional view of a turbine stage of the present invention, showing the spill seal hereof supported in the diaphragm of the turbine stage and the rotor of the upstream turbine stage.

As best shown in FIGS. 2 and 6, a continuously extending tip seal 16A is formed between each rotor shroud 10 and adjacent diaphragm 6A, using a ring of spillstrips 17A of the present invention (i.e., hereinafter referred to as "spillstrip ring"). As best shown in FIG. 3, spillstrip ring 17A is mounted in a circumferentially extending groove 18A formed in the spillstrip holding portion 19A of diaphragm 6A.

Figure 10:
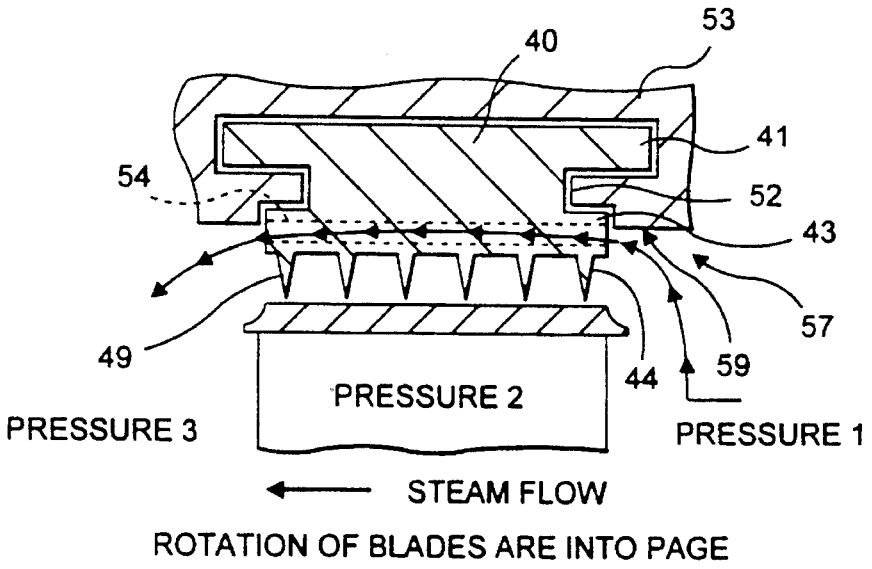
FIG. 10 is a schematic diagram illustrating the flow of entrained particles through the particle channel formed in the spillstrip of FIG. 9, without interrupting the tip seal formed thereby.

In general, the construction of the spillstrip ring of the present invention, and the tip seal formed thereby, may vary from embodiment to embodiment. A first illustrative embodiment of the spillstrip ring is shown in FIGS. 3 to 7. A second illustrative embodiment of the spillstrip ring is shown in FIGS. 8 and 10. As will be apparent to those skilled in the art, the first illustrative embodiment of the spillstrip design is well suited for use in low-pressure turbine stages where the diameter of turbine rotors and diaphragms are relatively large. The second illustrative embodiment of the spillstrip design is ideally suited for higher pressure turbine stages where the diameter of turbine rotors and diaphragms are relatively smaller. These illustrative embodiments shall be described in detail below.

As shown in FIG. 3, the first turbine stage of the first embodiment of the present invention includes stationary diaphragm 6A comprising an outer ring portion 15A seated in a complementary joint 7A in outer turbine casing 2; a ring of steam directing nozzles 13A supported with the outer ring portion; and an inner ring portion 14A contained within the nozzle ring.

As shown in FIG. 3, the first turbine stage includes rotor structure 4A comprising: an inner ring portion 9A attached to turbine shaft 5; a plurality of blades (i.e., buckets) 8A each being fixedly attached to inner ring portion 9A; and a circumferentally extending shroud band (i.e., blade cover) 10A, which is secured to the tenon of each turbine blade. The rotating and stationary components comprising the various stages of the turbine are enclosed within the outer turbine casing 2.

In the first illustrative embodiment, adequate steam seals between each stationary diaphragm and its associated turbine rotor are provided using two distinct steam sealing mechanisms. The details of these steam sealing mechanisms are described below.

In accordance with convention, a retractable packing ring 20A is seated in a complementary groove 21A formed in the inner ring portion 14A of diaphragm 6A, as shown in FIG. 3. The function of this retractable packing ring is to establish a steam seal between the inner ring portion 14A of diaphragm 6A and the outer surface 22A of rotor 4A. An exemplary retractable packing ring is disclosed in U.S. Pat. No. 4,436,311 to Brandon, which is incorporated herein by reference in its entirety.

In accordance with the present invention, spillstrip ring 17A of the first illustrative embodiment is seated in a complementary groove 18A formed in a spillstrip holding portion 19A that is formed as an extension on the inner face 23A of the outer ring 15C of the subsequently downstream turbine diaphragm. In general, a large number of these spillstrips are assembled together along this groove in order to construct spillstrip ring 17A, as best illustrated in FIG. 6. Also, the exact manner in which spillstrip ring 17A is supported from a diaphragm at any particular stage may vary from embodiment to embodiment of the present invention.

Figure 4:
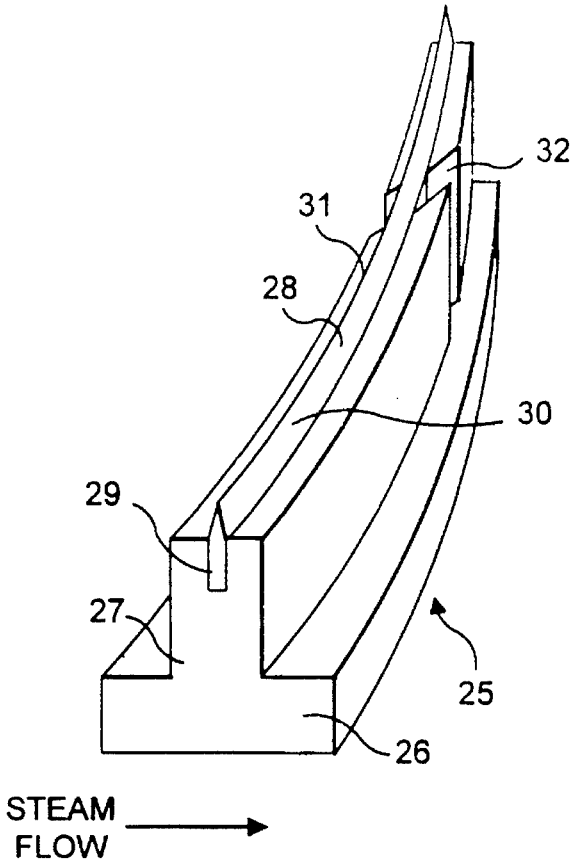
FIG. 4 is a perspective view of the first illustrative embodiment of the spillstrip of the present invention, showing the T-shaped cross-sectional dimensions of its body portion, its tapered projection extending therefrom, and the particle channel formed through the body portion and beneath the tapered projection.

As shown in FIG. 4, each spillstrip 25 in spillstrip ring 17A comprises a body portion having horizontally disposed cross piece 26 which extends longitudinally, and a vertical disposed body member 27 which extends substantially perpendicularly from horizontal cross piece 26. As shown, horizontally disposed cross-piece 26 and vertically disposed body member 27 form the T-shaped cross section of the spillstrip, which is precisely matched for seating in complementary groove 18A.

As shown in FIG. 4, a finger-like or tooth-like projection 28 projects upwardly from a groove 29 formed in the top portion of the vertically disposed body portion 27. The side walls 30 of projection 28 are tapered and converge to a narrow tip portion 31 having a continuous edge that also extends along the longitudinal extent of the cross-piece 26. In the illustrative embodiment, projection 28 is fabricated from a different piece of metal than that used to fabricate the body portion of the spillstrip. Projection 28 is the press-fitted into groove 29 using conventional machining techniques. It is understood, however, that spillstrip 25 of the present invention can be machined from a single piece of metal.

Figure 5:
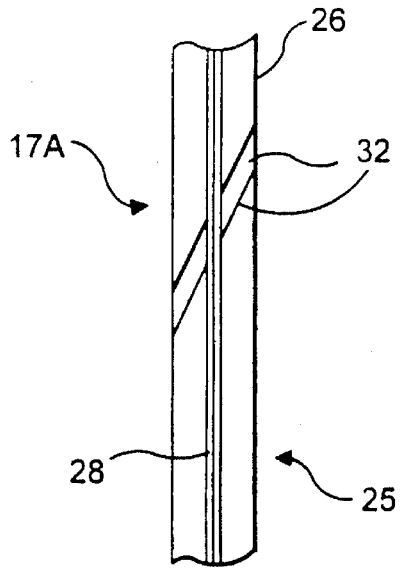
FIG. 5 is a plan view of the first illustrative embodiment of the spillstrip of the present invention, showing the orientation of the particle channel formed through the body portion of the spillstrip, and underneath the tapered projection thereof.

While each spillstrip in spillstrip ring 17A is manufactured as described above, one or more spillstrips in the ring will have a narrow particle channel 32 formed entirely through the vertically disposed body portion 27 thereof and beneath tooth-like projection 28 of the spillstrip, as shown in FIGS. 2, 4, and 5. Preferably, particle channel 32 is oriented at an oblique angle with respect to the longitudinal extent of the spillstrip to optimize the transport of oxide particles therethrough during turbine operation. Preferably, the width dimension of channel 32 is in the range of about of 15 to about 16 millimeters, and the height dimension thereof is in the range of about 10 to about 15 millimeters. It is understood, however, that in other embodiments of the present invention, the orientation and the dimensions of the particle channel may vary, provided that the continuous edge of the tip portion 27 of the spillstrip is not disrupted. In order to protect the side wall surfaces of the vertically disposed body portion 27 and continuously extending tip portion 31 against wear (i.e., erosion) when impacted by hard metallic particles during turbine operation, a coating of chrome carbide is applied to the side wall surfaces of the spillstrip on the high pressure P1 side thereof and also to the channel through which the particles flow.

Figure 7:
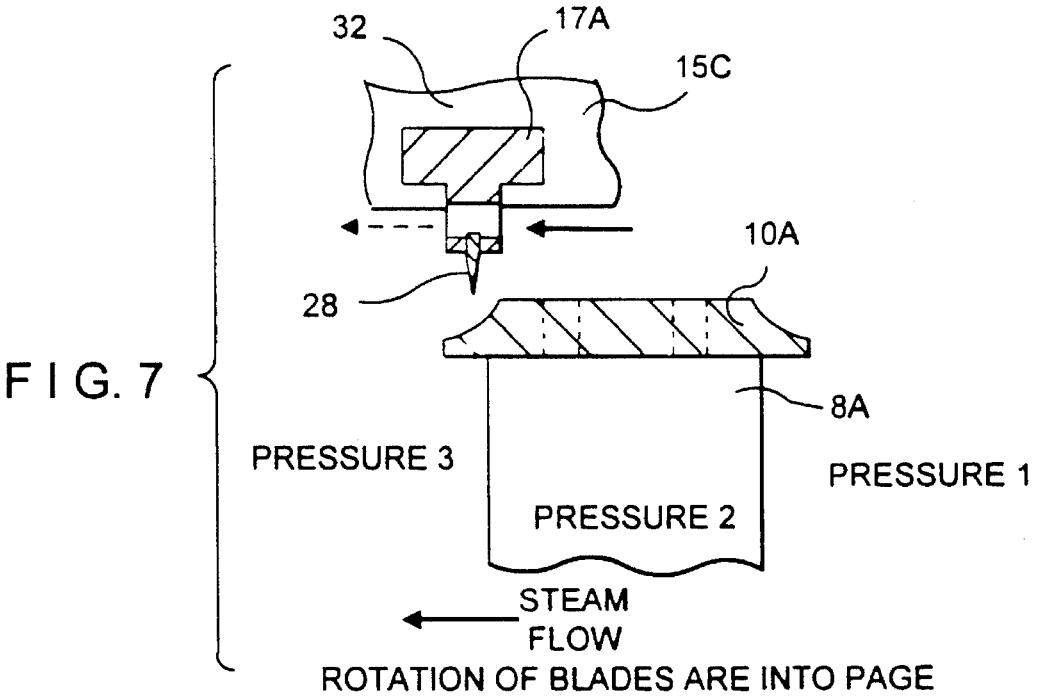
FIG. 7 is a schematic diagram illustrating the flow of entrained particles through the particle channel formed in the spillstrip of FIG. 4, without interrupting the tip seal formed thereby.
Figure 8:
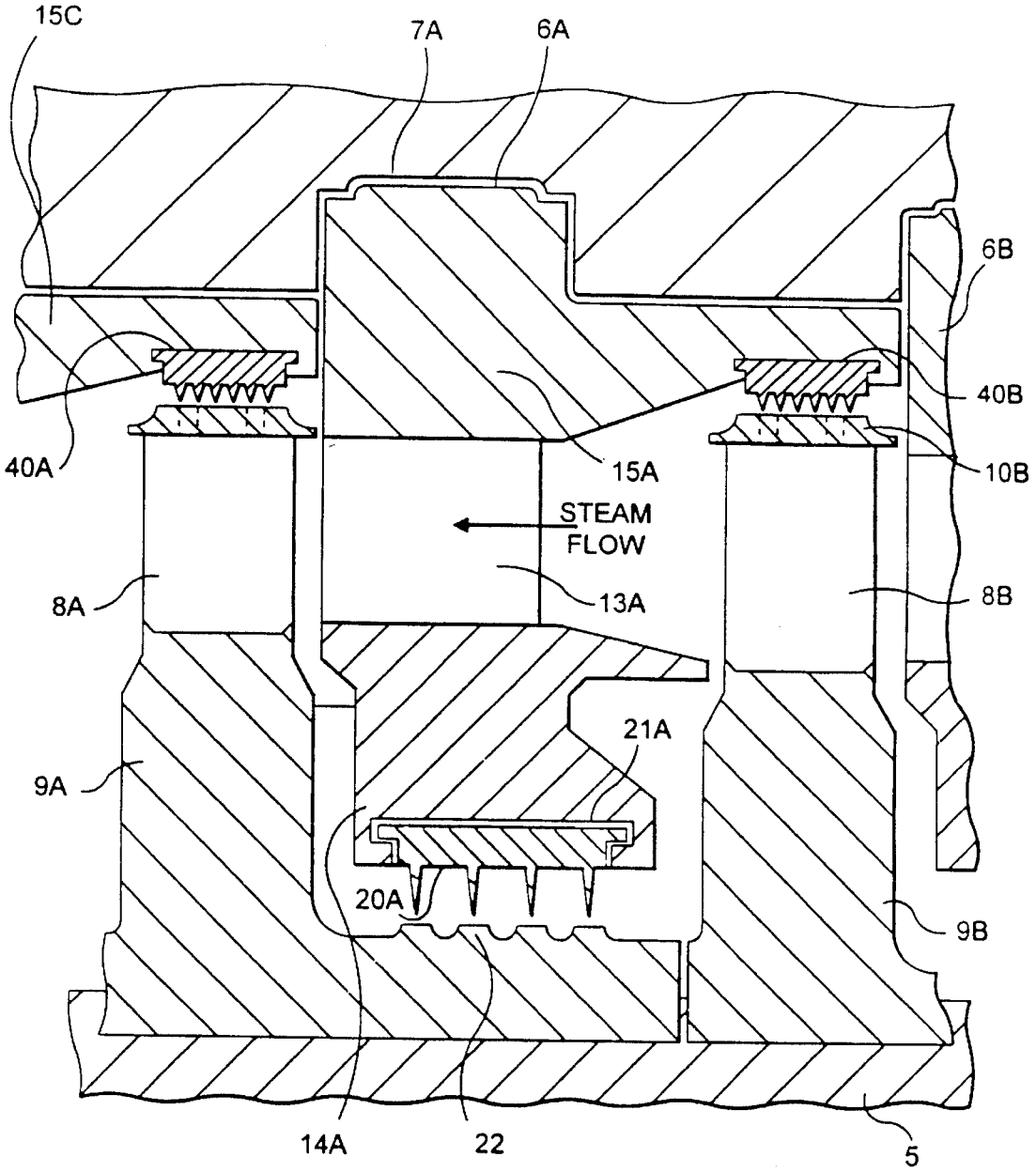
FIG. 8 is a cross-sectional view of a turbine stage of the present invention, showing the second illustrative embodiment of the spillstrip ring and the manner in which it is supported from the diaphragm of the turbine stage and forms a continuous tip seal with the shroud of its associated turbine rotor.

The flow of steam and entrained erosive particles through spillstrip 25 of the present invention is schematically illustrated in FIG. 7. In general, steam flows through an axial flow steam turbine along the axial direction of its turbine shaft. However, there are subtle variations to this steam flow which the spillstrip ring of the present invention advantageously exploits, as described below.

During the operation of the turbine of the present invention, the nozzles of each diaphragm direct pressurized steam against the blades of the rotor in order to impart torque to the turbine shaft. As such, each oxide particle entrained in the steam flow has tangential velocity component which causes these particles to move helically about the turbine shaft. Consequently, centrifugal forces act on these oxide particles during their axial travel through the turbine. While the oxide particles tend to bounce in seemingly unpredictable directions when colliding with the rotor blades, the centrifugal forces acting on these particles impose a degree of order on their apparently random movement between the rotor blades and associated diaphragm nozzles.

The net effect of the centrifugal forces on oxide particle travel through axial flow steam turbines, is that there is a greater likelihood that these particles have greater residency times at radial distances farther away from the turbine shaft, than at radial distances closer to the turbine shaft. The present invention exploits this aspect of oxide particle travel by locating particle channel(s) 32 at radial distances that are the farthest possible from the turbine shaft. In addition, the orientation of each particle channel 32 is in the same direction as the helically traveling particles about the outermost portion of the inner walls of the diaphragm. In this way, oxide particles are permitted to quickly bypass the blades of the rotor, via particle channel 32, and minimize the damage which they would cause if permitted to dwell longer between the turbine blades and nozzles at any particular turbine stage.

Figure 9:
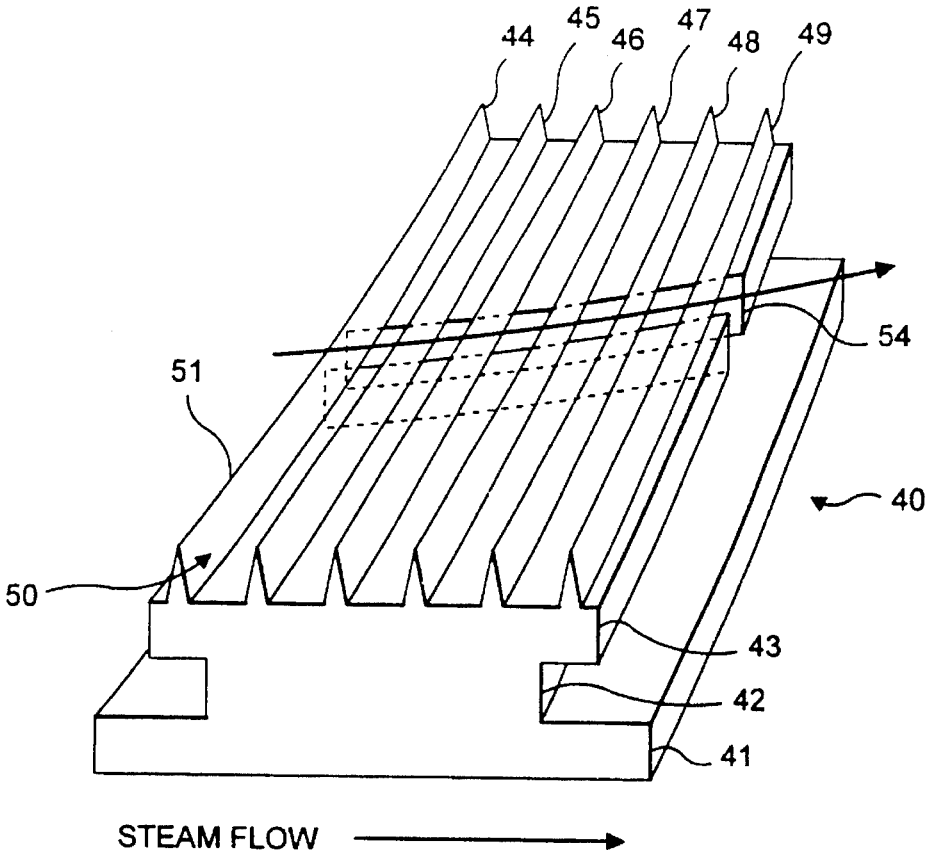
FIG. 9 is a perspective view of the second illustrative embodiment of the spillstrip of the present invention, showing the T-shaped cross-sectional dimensions of its body portion, the rows of tapered tip projections extending therefrom, and the particle channel formed through the body portion and underneath the rows of tapered projections.

In FIG. 9, a single spillstrip element 40 of the second illustrative embodiment is shown. In general, a large number of these spillstrip elements are assembled to construct spillstrip ring 17' shown in FIG. 8. As shown in FIG. 9, each spillstrip 40 comprises a body portion having first horizontally disposed cross-piece portion 41 with a longitudinal extent; a vertical disposed body member 42 which extends substantially perpendicularly from cross-piece portion 41; and a second horizontally disposed cross-piece 43-with a longitudinal extent as well. As shown in FIG. 8, a plurality of finger-like or tooth-like projections 44 to 49 extend vertically upward from the top surface of the second cross-piece 43. The side walls 50 of each projection are tapered and converge to a tip portion 51 having a continuous edge that also extends along the longitudinal extent of the first and second cross-piece portions 41 and 43. In the illustrative embodiment, each projection 51 is machined from a single piece of metal. It is understood, however, that the projections of each spillstrip 40 can be fabricated from a different piece of metal than used to fabricate vertically disposed body portion 42 and cross-piece portions 41 and 43. Thereafter, the projection 51 can be press-fitted silver soldered-tip welded into a groove formed along the top surface of second cross-piece 43.

As shown in FIG. 8, the body portion of each spillstrip 40 is seated in a complementary groove 52 formed in spillstrip holder portion 53 of diaphragm 6A. In all other respects, each the turbine stage of the second illustrative embodiment is similar to the turbine stage shown in FIG. 3.

While each spillstrip in spillstrip ring 17' is manufactured as described above, one or more spillstrips in the ring will have a narrow particle channel 54 formed entirely through the second cross-piece 43 and beneath the plurality of tooth-like projections 44 to 49, as shown in FIGS. 2, 8, and 9. Preferably, particle channel 54 is oriented at an oblique angle with respect to the longitudinal extent of the spillstrip to facilitate transport of oxide particles therethrough. Preferably, the width dimension of each channel 53 is in the range of about of 10 to about 15 millimeters, and the height dimension thereof is in the range of about 10 to about 15 millimeters. In other embodiments, the orientation and the dimensions of particle channel 54 may vary, provided that the continuous extending tip portion of the spillstrip ring is not disrupted. In order to protect second cross-piece 43 and finger-like projections 44 to 49 against wear (i.e., erosion) when impacted by hard particles moving in the downstream direction, a coating of chrome carbide is applied to the side wall surfaces of the spillstrip on the higher pressure side thereof and also to the channel area.

The random flow of hard erosive particles through spillstrip 40 is schematically illustrated in FIG. 10. As in the first illustrative embodiment of the spillstrip, each oxide particle entrained in the steam flow has a tangential velocity component which causes the particle to move helically about the turbine shaft. Centrifugal forces act on these oxide particles during their axial travel through the turbine stages. The net effect of the centrifugal forces is there is a greater likelihood that these particles have greater residency times at radial distances farther away from the turbine shaft, than at radial distances closer towards the turbine shaft. Thus, in each "channeled spillstrip" 40 of the second illustrative embodiment, each particle channel(s) 54 is located at a radial distance that are the farthest possible from the turbine shaft. Also, the orientation of each particle channel 54 in the spillstrip is in the same direction as the helically traveling particles about the outer most portion of the inner walls of the diaphragm. In this way, oxide particles are permitted to quickly bypass the blades of the rotor, via particle channel 53, as described above.

The spillstrip rings of both illustrative embodiments function in essentially the same way. Specifically, steam discharged from the nozzle rings of the diaphragms impart high tangential (i.e., circumferential) velocities to the metal particles entrained therein. These particles are centrifuged to the outside of the steam flow path and some reside in space 57 adjacent the spillstrip 40 and between the outside of the rotor shroud and the inner wall surface 59 of the diaphragm. Being centrifuged radially outwardly, many of these metal particles pass through channel 54, and downstream to the subsequent turbine stage, where the bypass process is repeated. The net effect of channel 54 is that metal particles are permitted to quickly bypass the rotor blades as they are centrifuged radially outwardly from the diaphragm nozzle rings. Yet, as the provision of these channels avoid any sort of disruption in the continuous geometry of the tip portions along the spillstrip ring, the tip seal formed between each rotor shroud and diaphragm inner wall is maximized by allowing a substantial uniform radial clearance along the full circumferential extent thereof, as shown in FIG. 6. Consequently, the spillstrip ring of the present invention is able to avoid the inherent steam pressure losses resulting across the tip seal portion of the prior art spillstrip design proposed in U.S. Pat. No. 5,271,712, supra.

Figure 11:
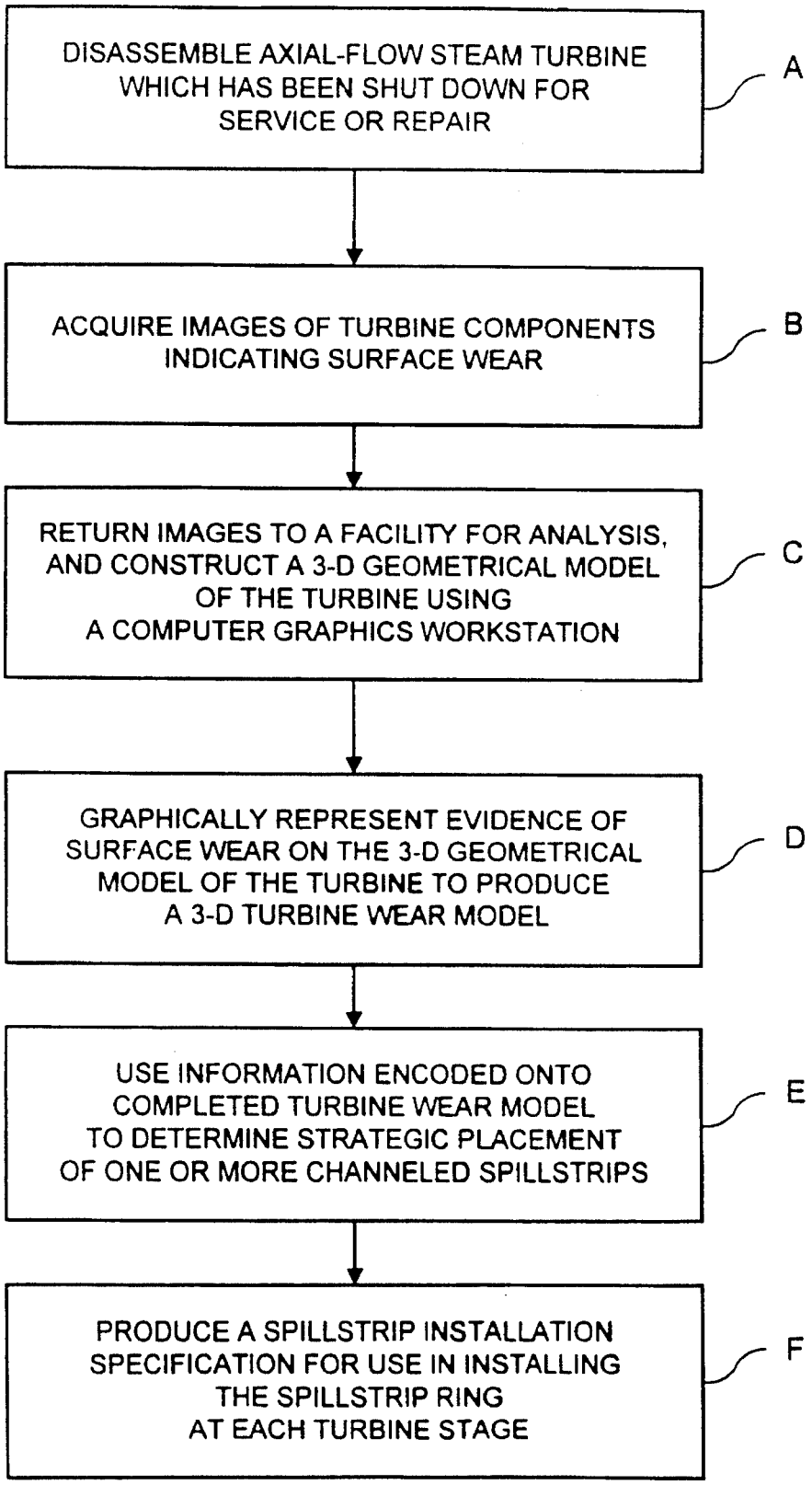
FIG. 11 is a flow chart illustrating a novel method of strategically installing the spillstrip of the present invention.
Figure 12:
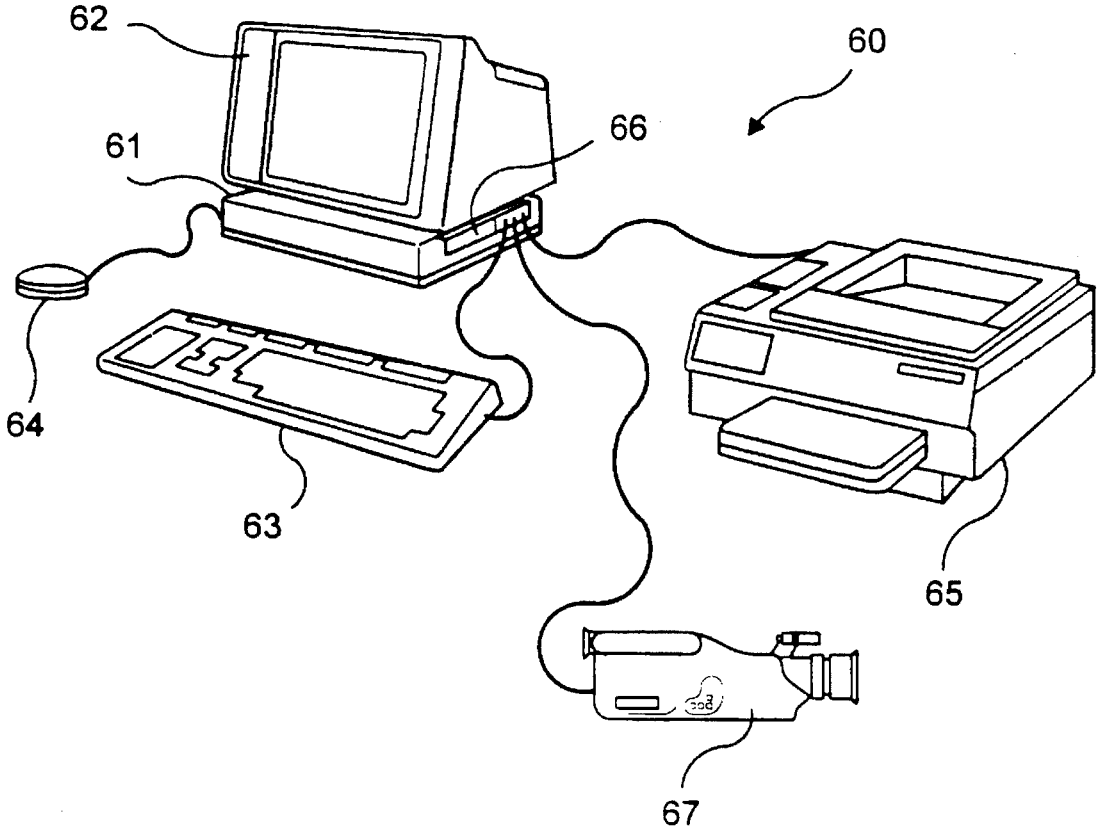
FIG. 12 is a schematic representation of a 3-D computer graphics workstation used in carrying out the method of the present invention.

In accordance with the present invention, the method shown in FIG. 11 is used to install the spillstrip ring of the present invention in conventional steam turbine which has been shut down for repair( e.g., maintenance). Preferably the method of FIG. 11 is carried out using the computer workstation 60 of FIG. 12. In general, workstation 60 comprises a computer system 61 having a color monitor 62, keyboard 63, pointing and selecting device 64, a printer 65, and video-input ports 66 for receiving high resolution color images acquired from a portable image acquisition device 67 (e.g., CED video camera). In the preferred embodiment, the computer system implements an operating system such as provided by Unix® X-Windows operating system software, to allow the workstation to support a plurality of input/output windows, pointing and selecting device 64, and image acquisition device 67. Also the computer system is equipped with a suitable 3-D CAD program for creating a 3-D Turbine Wear Model which will be described in greater detail below.

As indicated at Block A of FIG. 11, the first step of the method involves disassembling the turbine which has been shut down for repair. As indicated at Block B in FIG. 11, image acquisition device 67 is used to acquire high-resolution color images of all of the turbine components exhibiting even the slightest signs of surface erosion or wear. As indicated at Block C, the high-resolution color images collected at Block B are returned to an analysis and modeling facility (e.g., engineering office) where they are analyzed and subsequently used to construct and graphically represent a 3-D "Turbine Wear Model" using the 3-D computer workstation of FIG. 12.

In general, the Turbine Wear Model consists of a 3-D geometrical model (e.g., wire frame mesh model) of the major turbine components including, for example, the turbine diaphragms, turbine rotors, turbine shaft seals, etc. Notably, this model should be geometrically accurate, and preferably a polar coordinate system is embedded in the model at each turbine stage. This makes it possible to accurately specify the best angular position for spillstrip placement about its spillstrip ring, in view of the collected evidence of component wear (e.g., surface wear of spillstrip rings, diaphragm nozzles, and rotor blades).

At Block D in FIG. 11, collected evidence of surface wear is graphically represented upon the surface geometry of the 3-D geometrical model of the disassembled and analyzed turbine. This can be accomplished mapping graphical indicia such as color codes or numbers, onto corresponding surface location where such erosion is evidenced by photographic imagery recorded during the disassembly process. Preferably, a different class of color codes are assigned to stationary turbine surfaces and rotating turbine surfaces exhibiting wear.

At Block E, information encoded onto the completed Turbine Wear Model is then used to determine strategic placement of one or more channeled spillstrip of the present invention along the spillstrip ring at each turbine stage. Preferably, such strategic locations are specified in degrees with respect to the polar coordinate system embedded at the turbine stage. Typically, "channeled spillstrips" will be placed where there appears to be relatively high degrees of wear, indicative of local build-up of metallic particles in the turbine which require rotor bypassing. Notably, as channeled spillstrips are located along the spillstrip rings strictly on the basis of prior knowledge of turbine component surface wear, the channeled spillstrips will appear (to an outside observer) as being randomly installed along the axial extent of the repaired turbine, when in fact they have been strategically installed to reduce surface wear of turbine components. The workstation can be used to print out "spillstrip installation blueprints" which specify the exact location of channeled spillstrips along each particular spillstrip ring.

Finally, as indicated at Block F, the produced spillstrip installation specification is used to install the spillstrip ring at the end stage of the turbine.

Various other modifications to the illustrative embodiment of the present invention will readily occur to persons with ordinary skill in the art. All such modifications and variations are deemed to be within the scope and spirit of the present invention as defined by the accompanying Claims to Invention.

What is claimed is:

1. A spillstrip for use in forming a tip seal in an axial flow elastic fluid turbine including at least one stage having at least one diaphragm stationarily mounted in a turbine casing and having a plurality of steam directing nozzles, and a rotor fixedly attached to a turbine shaft rotatably mounted within said turbine casing, said rotor having a plurality of blades bounded by a shroud and disposed adjacent said plurality o steam directing nozzles, said spillstrip comprising:

a body portion having a longitudinal extent, a vertical extent, and a horizontal extent, and being particularly adapted for mounting in a groove formed in said diaphragm;

at least one projection extending from said body portion substantially parallel to said vertical extent and along the longitudinal extent of said body portion, said at least one projection having tapered side walls converging to a tip portion continuously extending along the longitudinal extent of said body portion and forming a tip seal with the shroud of said rotor; and a narrow channel formed through a portion of the vertical extent of said body portion and beneath said at least one projection, without interrupting said tip portion continuously extending along the longitudinal extent of said body portion, and said narrow channel being disposed at an oblique angle with respect to said longitudinal extent.

2. The spillstrip of claim 1, wherein said body portion and said projection are formed from a single piece of material.

3. A spillstrip ring for use in forming a tip seal in an axial flow elastic fluid turbine including at least one stage having a diaphragm stationarily mounted in a turbine casing and having a plurality of steam directing nozzles, and a rotor fixedly attached to a turbine shaft rotatably mounted within said turbine casing, said rotor having a plurality of blades surrounded by a shroud and disposed adjacent said plurality of steam directing nozzles, said spillstrip ring comprising:

a plurality of spillstrips, each said spillstrip being mounted in a groove circumferentially formed in said diaphragm;

each said spillstrip including a body portion having a longitudinal extent, a vertical extent, and a horizontal extent, and being particularly adapted for mounting in said groove circumferentially formed in said diaphragm; and a projection extending from said body portion substantially parallel to said vertical extent and along the longitudinal extent of said body portion, said projection having tapered side walls converging to a tip portion continuously extending along the longitudinal extent of said body portion, and forming a tip seal with the shroud of said rotor; and at least one of said plurality of spillstrips having at least one narrow channel formed entirely through a portion of the vertical extent of said body portion and beneath said projection, without interrupting said tip portion continuously extending along the longitudinal extent of said body portion, and said at least one narrow channel being disposed at an oblique angle with respect to said longitudinal extent.

4. The spill strip ring of claim 3, wherein said body portion and said projection of each said spillstrip are formed from a single piece of material.

5. A spillstrip for use in forming a tip seal in an axial flow elastic fluid turbine including at least one stage having at least one diaphragm stationarily mounted in a turbine casing and having a plurality of steam directing nozzles, and a rotor fixedly attached to a turbine shaft rotatably mounted within said turbine casing, said rotor having a plurality of blades bounded by a shroud and disposed adjacent said plurality of steam directing nozzles, said spillstrip comprising:

a body portion having a longitudinal extent, a vertical extent, and horizontal extent, and being particularly adapted for mounting in a groove formed in said diaphragm;

a plurality of projections, each said projection extending from said body portion substantially parallel to said vertical extent and along the longitudinal extent of said body portion, and each said projection having tapered side walls converging to a tip portion continuously extending along the longitudinal extent of said body portion and forming a tip seal with the shroud of said rotor; and a narrow channel formed through a portion of the vertical extent of said body portion and beneath said plurality of projections, without interrupting any of said tip portions continuously extending along the longitudinal extent of said body portion, and said narrow channel being disposed at an oblique angle with respect to said longitudinal extent.

6. The spillstrip of claim 5 wherein said body portion and each said projection are formed from a single piece of material.

7. A spill strip ring for use in forming a tip seal in an axial flow elastic fluid turbine including at least one stage having a diaphragm stationarily mounted in a turbine casing and having a plurality of steam directing nozzles, and a rotor fixedly attached to a turbine shaft rotatably mounted within said turbine casing, said rotor having a plurality of blades surrounded by a shroud and disposed adjacent said plurality of steam directing nozzles, said spillstrip ring comprising:

a plurality of spillstrips, each said spillstrip being mounted in a groove circumferentially formed in said diaphragm;

each said spillstrip including a body portion having a longitudinal extent, a vertical extent, and a horizontal extent, and being particularly adapted for mounting in said groove circumferentially formed in said diaphragm; and a plurality of projections, each said projection extending from said body portion substantially parallel to said vertical extent and along the longitudinal extent of said body portion, and each said projection having tapered side walls converging to a tip portion continuously extending along the longitudinal extent of said body portion, for use in forming a tip seal with the shroud of said rotor; and at least one of said plurality of spillstrips having at least one narrow channel formed entirely through a portion of the vertical extent of said body portion and beneath said plurality of projections, without interrupting any of said tip portions continuously extending along the longitudinal extent of said body portion, and said at least one narrow channel being disposed at an oblique angle with respect to said longitudinal extent.

8. The spillstrip ring of claim 7, wherein said body portion and said tip portion of each said spillstrip are formed from a single piece of material.

9. An axial flow elastic fluid turbine comprising:

an outer casing containing an interior volume;

a turbine shaft rotatably supported within the interior volume of said outer casing; and a plurality of turbine stages installed along said turbine shaft and contained within said outer casing, each said turbine stage including a diaphragm stationarily mounted in a recess formed in said turbine casing and having a plurality of steam directing nozzles, a rotor fixedly attached to said turbine shaft and having a plurality of blades bounded by a shroud band and being disposed adjacent said plurality of steam directing nozzles, and a spillstrip ring consisting of an arrangement of spillstrips mounted in a circumferentially extending groove formed in said diaphragm and providing a continuously extending tip seal with said shroud band of said rotor, each said spillstrip including a body portion having a longitudinal extent, a vertical extent, and a horizontal extent, and being particularly adapted for mounting in said groove circumferentially formed in said diaphragm, and at least one projection extending from said body portion substantially parallel to said vertical extent and along the longitudinal extent of said body portion, said projection having tapered side walls converging to a tip portion continuously extending along the longitudinal extent of said body portion, and at least one of said plurality of spillstrips having at least one narrow channel formed entirely through a portion of the vertical extent of said body portion and beneath at least one said projection, without interrupting said tip portion continuously extending along the longitudinal extent of said body portion, and said at least one narrow channel being disposed at an oblique angle with respect to said longitudinal extent.

10. The axial flow elastic fluid turbine of claim 9, wherein said body portion and said projection being formed from a single piece of material.

11. An axial flow elastic fluid turbine comprising:

an outer casing;

a turbine shaft rotatably supported in said outer casing; and a plurality of turbine stages installed along said turbine shaft and contained within said outer casing, each said turbine stage including a diaphragm stationarily mounted in a recess formed in said turbine casing and having a plurality of steam directing nozzles, a rotor fixedly attached to said turbine shaft and having a plurality of blades bounded by a shroud band and being disposed adjacent said plurality of steam directing nozzles, and a spillstrip ring consisting of an arrangement of spillstrips mounted in a circumferentially extending groove formed in said diaphragm and providing a continuously extending row of tip seals with said shroud band of said rotor, each said spillstrip including a body portion having a longitudinal extent, a vertical extent, and a horizontal extent, and being particularly adapted from mounting in said groove circumferentially formed in said diaphragm, and a plurality of projections, each said projection extending from said body portion substantially parallel to said vertical extent and along the longitudinal extent of said body portion and each said projection having tapered side walls converging to a tip portion continuously extending along the longitudinal extent of said body portion, and at least one of said plurality of spill strips having at least one narrow channel formed entirely through a portion of the vertical extent of said body portion and beneath said plurality of projections, without interrupting any of said tip portions continuously extending along the longitudinal extent of said body portion, and said at least one narrow channel being disposed at an oblique angle with respect to said longitudinal extent.

12. The axial flow elastic fluid turbine of claim 11, wherein said body portion and said projections of each said spillstrip being formed from a single piece of material.

* * * * *